US005638973A

United States Patent [19]

Dewey et al.

[11] Patent Number: 5,638,973

[45] Date of Patent: Jun. 17, 1997

[54] STORAGE CONTAINER WITH INTERLOCKING CORNER MEMBERS

[75] Inventors: Richard W. Dewey, Seattle; E. James Long, Redmond; Jon Chester-Bristow, Issaquah; David B. Petrich, Seattle, all of Wash.

[73] Assignee: Western Poly Corporation, Bellevue, Wash.

[21] Appl. No.: 647,300

[22] Filed: May 9, 1996

[51] Int. Cl.[6] ..... B65D 8/00; B65D 25/00

[52] U.S. Cl. ..... 220/4.33; 206/509

[58] Field of Search ..... 220/4.33, 4.32, 220/1.5; 206/509

[56] References Cited

U.S. PATENT DOCUMENTS

| | | | |
|---|---|---|---|
| 3,307,729 | 3/1967 | Schwartz | 206/509 X |
| 3,561,633 | 2/1971 | Morrison | 220/1.5 |
| 3,985,258 | 10/1976 | Quigley et al. | 220/4.33 X |
| 3,989,156 | 11/1976 | Lowry | 220/4 F |
| 4,000,827 | 1/1977 | Emery | 220/4.33 X |
| 4,776,477 | 10/1988 | Walker | 220/4 F |
| 4,809,851 | 3/1989 | Oestreich, Jr. et al. | 206/599 |
| 4,809,859 | 3/1989 | Chung | 220/4 R |
| 5,234,120 | 8/1993 | Bandera | 220/4.28 |
| 5,236,099 | 8/1993 | Fties et al. | 220/4.31 |
| 5,263,576 | 11/1993 | Boreen et al. | 206/45.34 |
| 5,279,438 | 1/1994 | Cesano | 220/7 |
| 5,289,933 | 3/1994 | Streich et al. | 220/1.5 |
| 5,398,834 | 3/1995 | Umiker | 220/6 |
| 5,452,817 | 9/1995 | Taravella et al. | 220/4.33 |

*Primary Examiner*—Steven M. Pollard
*Attorney, Agent, or Firm*—Seed and Berry LLP

[57] ABSTRACT

A collapsible agricultural storage container having a base, and a plurality of side panels removably connected to the base panel and interlocked at their edges by elongated, removable corner members. Each side panel is adjacent to two other side panels, and each side panel has first and second edge portions having a key member extending therefrom. Each corner member has a pair of keyways that slidably receive the key members of adjacent side panels to interlock the side panels together. The side panels include a top edge portion having an aligning rail extending upwardly away from a stacking support for alignment of an upper storage container stacked atop a lower storage container. Each side panel also has a bottom foot portion that extends below the base panel and slopes inwardly of the aligning rail to a position directly below the stacking support. The bottom foot portion has guideways and footrail portions spanning across the guideways to provide a closed, four-sided aperture that is shaped and sized to receive the fork of a forked moving device used to move the storage container.

15 Claims, 4 Drawing Sheets

STORAGE CONTAINER WITH INTERLOCKING CORNER MEMBERS

TECHNICAL FIELD

The present invention relates to storage containers, and more particularly to agricultural and other commercial storage containers.

BACKGROUND OF THE INVENTION

Agricultural storage containers are used for storing agricultural products and for transporting the agricultural products, such as produce or other food stuff, from a field to a processing location. Conventional wood agricultural storage boxes are constructed of four wood side panels that are bolted, screwed, or otherwise fastened together and fastened to a wood base. Although the wood storage boxes hold large volumes of agricultural products, the storage boxes require a large amount of storage space when not in use. Some of the wood storage boxes can be disassembled by unscrewing or unbolting many fasteners to separate the side panels from each other and from the base, but such disassembly is very time consuming, labor intensive, and accordingly, uneconomical.

Other conventional storage containers used in the agricultural industry are one-piece, molded, plastic containers that have the four sides integrally connected to each other and to a base. The one-piece plastic containers cannot be disassembled, and they are stored by stacking them horizontally and vertically in a selected storage area. However, such storage of one-piece plastic containers does not efficiently use storage space.

In most situations, time and storage space is at a premium, and it is highly desirable to have storage containers that can be easily and quickly disassembled when not in use and reassembled for holding products. A disassembled storage container used for storing or transporting produce is approximately one-sixth the size of the assembled storage container, thereby substantially minimizing the space required for storing the storage container. It is also highly desirable to have a storage container that can be transported while disassembled and then quickly assembled in the field or other remote location just before the container is to be filled.

A further drawback suffered by conventional agricultural storage containers occurs in vertical stacking of the containers, whether they are empty or full of products. The storage containers typically have substantially flat bottom panels with the same dimensions as the top of the containers, and when stacked vertically, the bottom panel of an upper container is positioned atop the sidewalls of a lower container. The storage containers must be carefully stacked and aligned to ensure for a steady vertical stack. To ensure that misalignment of the storage containers does not occur, the storage containers must be stacked relatively slowly and carefully, thereby resulting in a time-consuming and expensive stacking procedure.

SUMMARY OF THE INVENTION

The present invention provides a collapsible storage container that has a plurality of side panels removably connected to a base panel. The side panels are removably interconnected by elongated corner members that can be quickly and easily attached to or removed from the side panels for assembly or disassembly of the containers. In a preferred embodiment of the invention, the storage container comprises four side panels and the base panel has four perimeter portions. Each of the side panels is removably connected to a perimeter portion of the base panel. Each of the side panels has fast and second edge portions spaced apart from each other, and each side panel is adjacent to two other side panels, such that the first edge portion of each side panel is adjacent to a second edge of one of the other side panels. Each of the first and second edge portions have a protruding key member that slidably engages a corner member that interlocks the adjacent key members of any two adjacent side panels. Each of the corner members is symmetrical about a longitudinally extending plane of symmetry, and each corner member has a pair of keyways therein that slidably receives the protruding key members on the adjacent side panels to define a corner of the container.

The side panels of the collapsible storage container each have a top edge portion that extends between the first and second edge portions. The top edge portion has a flat stacking support and a stacking alignment rail extending upwardly away from the stacking support. The alignment rail is located along an outer portion of the stacking support away from the interior area of the container, and the alignment rail is adapted to overlap a portion of a second storage container stacked atop the first storage container to align the second storage container onto the stacking supports of the first container's side panels.

Each side panel has a bottom foot portion opposite the top edge portion and below the base when the side panels are connected to the base. The bottom foot portion extends downwardly from the base and slopes inwardly of the stacking alignment rail. The bottom edge portion terminates at a bottom edge portion located directly below the stacking support of the side panel's top edge portion, such that when two storage containers are stacked one on top of the other, the bottom edge portions of the upper storage container's side panels set directly onto the flat stacking supports of the side panels of the lower container, thereby providing an aligned and stable configuration of vertically stacked agricultural storage containers.

The bottom foot portions of two opposing side panels have guideways therethrough shaped to removably receive a fork of a forked moving device used for lifting and moving the collapsible storage container. Footrail portions are attached to the bottom foot portions of the two opposing side panels. Each of the footrail portions span across a guideway to define a fork receiving aperture closed on four sides to retain the fork therein, for example, when the forked moving device lifts and inverts the storage container during a procedure in which a full storage container is emptied.

DETAILED DESCRIPTION OF THE INVENTION

Figure 1:
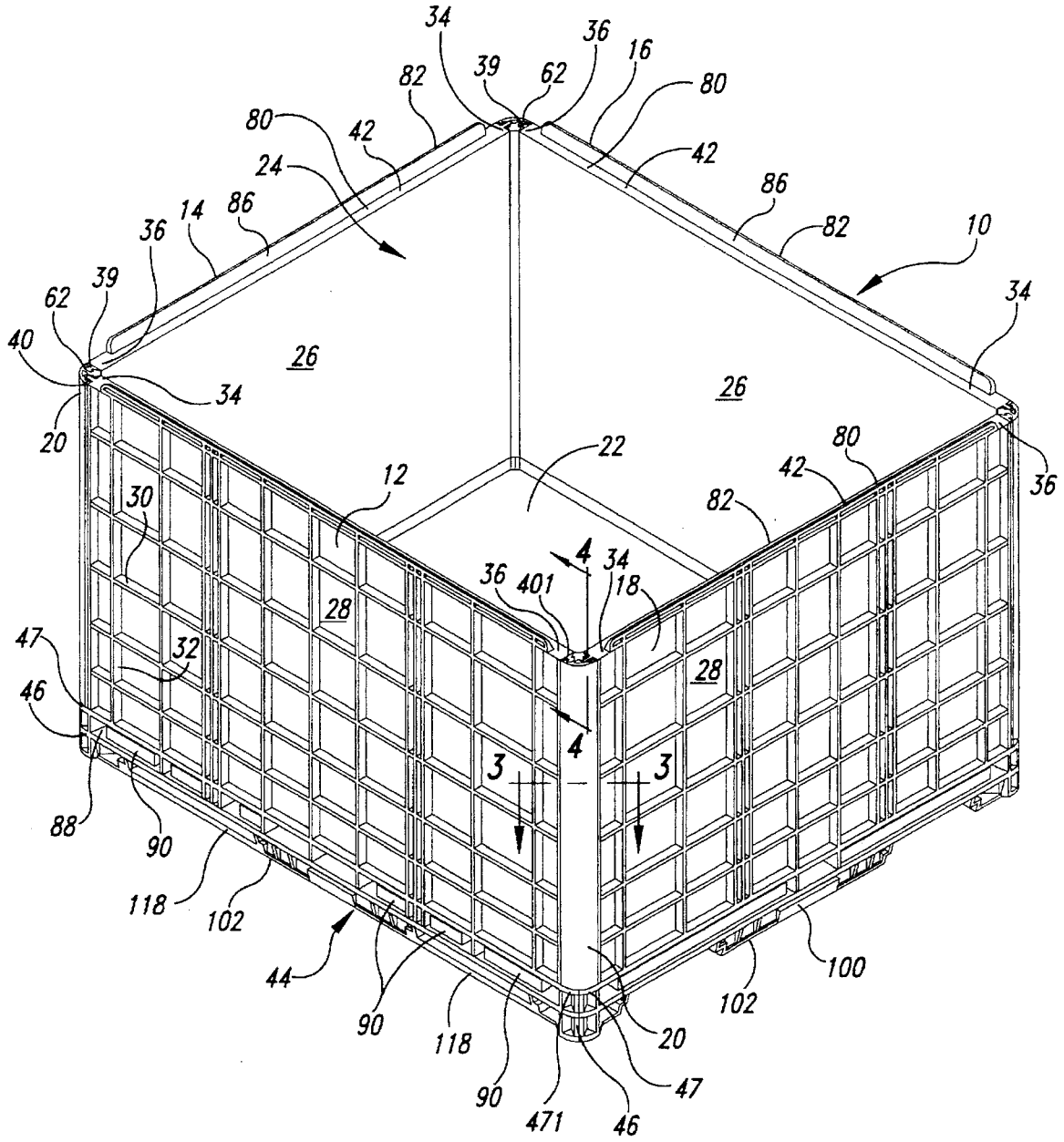
FIG. 1 is an isometric view of a collapsible agricultural storage container in accordance with the present invention.

A collapsible agricultural storage container 10 in accordance with the present invention is illustrated in FIG. 1. The storage container 10 includes four side panels 12, 14, 16, and 18 that are separably interlocked by four removable corner members 20. Each of the side panels is removably connected to a base panel 22 to define an interior area 24 that is adapted to receive and retain agricultural products such as apples, pears, cranberries, or other produce. The interior area 24 is about 21 bushels in size and can hold about 1,000 pounds of produce. The storage container 10 can be quickly and easily disassembled from an assembled configuration, illustrated in FIG. 1, to a disassembled configuration, illustrated in FIG. 2, to provide a collapsible container for storage or shipment. The corner members 20 are removed from the side panels 12, 14, 16, and 18, and the side panels are separated and removed from the base panel 22. When the storage container 10 is disassembled, the components of the storage container 10 can be stacked together in a collapsed configuration, and the disassembled storage container requires approximately one-sixth the storage space as is needed when the storage container is assembled. The storage container can be quickly and easily reassembled from the disassembled configuration to the assembled configuration for use to hold produce or other products.

Each of the side panels 12, 14, 16, and 18 has a generally smooth inner surface 26 and a waffle-patterned outer surface 28. The waffle-patterned outer surface 28 is defined by a plurality of criss-crossing horizontal and vertical ribs 30 and 32. In the preferred embodiment of the invention, the side panels 12, 14, 16, and 18 are constructed of molded plastic that is substantially rigid and that has sufficient strength that the side panels of the assembled storage container will bear the weight of other storage containers when stacked atop it.

Figure 2:
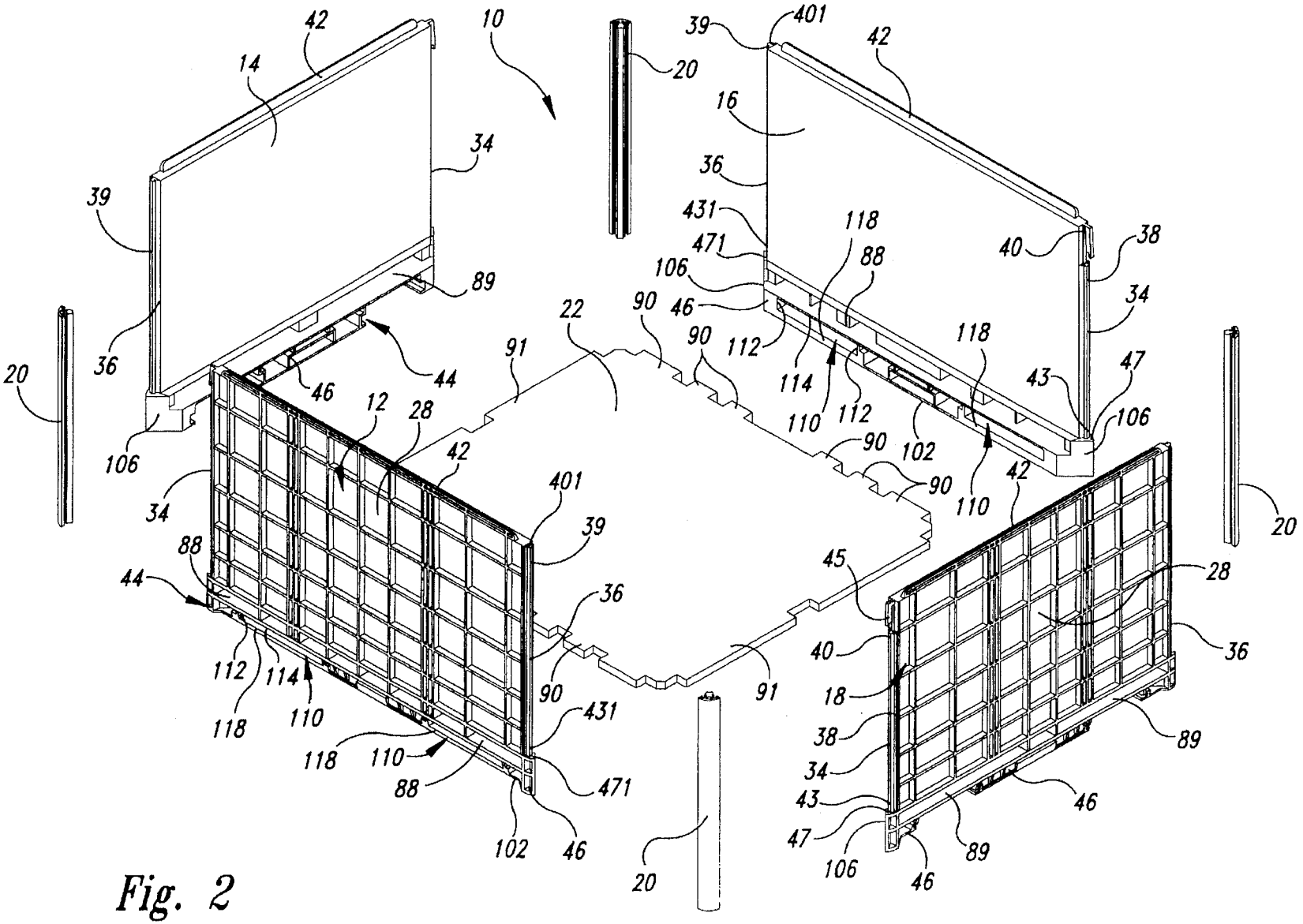
FIG. 2 is a reduced scale, isometric view of the storage container of FIG. 1 shown disassembled.

As best seen in FIGS. 1 and 2, each of the side panels 12, 14, 16, and 18 includes opposing, vertical first and second edge portions 34 and 36. Each of the first and second edge portions 34 and 36 has a key member 38 extending substantially along the length thereof. A top edge portion 42 extends between the first and second edge portions 34 and 36, as does a bottom foot portion 46 opposite the top edge portion. When the storage container is assembled as shown in FIG. 1, the four side panels 12, 14, 16, and 18 are arranged such that each side panel is perpendicularly, end-wise adjacent to two other side panels, and the top edge portions 42 define an open top side of the storage container 10. The first edge portion 34 of each side panel is adjacent to the second edge portion 36 of an adjacent one of the side panels. Similarly, the second edge portion 36 of each side panel is adjacent to the first edge portion 34 of one of the other side panels. The bottom foot portion 46 of each side panel is adjacent to the base panel 22 and together with the base panel define a closed bottom side of the storage container 10.

As best seen in FIG. 2, each of the first edge portions 34 of each side panel 12, 14, 16 and 18 has a deflectable locking tab 45 adjacent to the top edge portion 42 of the side panel, and an elongated, protruding key member 38 that extends substantially along the length of the first edge portion between the locking tab and the bottom foot portion 46. The key member 38 terminates at an upper end 40 adjacent to the locking tab 45 below the top edge portion 42 of the side panel, and at a bottom end 43 immediately above a shoulder 47 formed in the bottom foot portion 46.

Each of the second edge portions 36 of each side panel 12, 14, 16, and 18 has an elongated, protruding key member 39 that extends substantially along the length of the second edge portion. The key member 39 terminates at an upper end 401 adjacent to the top edge portion 42, and at a bottom end 431 immediately above a second shoulder 471 formed in the bottom foot portion 46. Accordingly, only the first edge portion 34 of each side panel has a locking tab 45. In an alternate embodiment, each of the first and second edge portions 34 and 36 have a locking tab 45 thereon.

The shoulders 47 and 471 provide lower blocking surfaces against which one of the corner members 20 is pressed to properly position the corner member relative to the side panels 12, 14, 16, and 18 to be connected together thereby when the storage container 10 is assembled.

Figure 3:
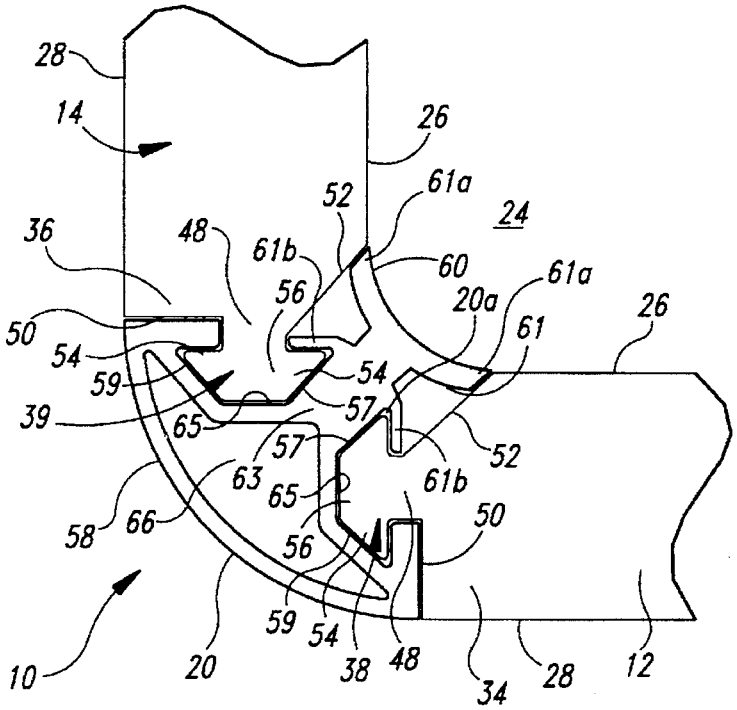
FIG. 3 is an enlarged, fragmentary cross-sectional view taken substantially along line 3—3 of FIG. 1 illustrating a corner member interlocking adjacent side panels.

As best seen in FIG. 3, each of the first and second edge portions 34 and 36 of the side panels 12, 14, 16 and 18 have a flat, outer surface 50 extending along the length thereof and a flat, angled inner surface 52 extending along the length thereof. The outer and inner surfaces 50 and 52 are located on opposite sides of the key member 38 of the first edge portion 34 and the key member 39 of the second edge portion 36. Each key member 38 and 39 has a generally T-shaped cross-section with a web 48 that extends away from the outer and inner surfaces 50 and 52, and connects to an elongated head 56. The web 48 is oriented substantially perpendicular to the outer surface 50, and is at approximately a 45° angle relative to the angled inner surface 52. Accordingly, adjacent key members 38 and 39 of adjacent side panels 12, 14, 16, and 18 are oriented with their webs 48 perpendicular to each other, as are the outer surfaces 50 of the adjacent first and second edge portions 34 and 36, and the angled inner surfaces 52 of the adjacent first and second edge portions.

The head 56 of each key member 38 and 39 has outer portions 54 that project from each side of the web 48 thereof and define inner and outer edge surfaces 57 and 59, respectively, of the head. The inner and outer edge surfaces 57 and 59 of each head 56 are angled with respect to each other at approximately 90°. Accordingly, inner edge surface 57 of the head 56 of one side panel is parallel to the inner edge surface and spaced apart from the inner edge surface of the adjacent head of the adjacent side panel to receive a portion **20*a* of the corner member 20** therebetween.

The corner members 20 are identical in construction and usage, so only one corner member will be discussed. As best seen in FIG. 3, the corner member 20 is symmetrical about a longitudinally extending, central plane. The corner member 20 extends between the adjacent first and second edge portions 34 and 36 of the two adjacent side panels 12 and 14. The corner member 20 has a pair of keyways 62 corresponding in size and shape to the key members 38 and 39, and each slidably receive a corresponding one of the key members of the two adjacent side panels 12 and 14 to releasably secure the two side panels together and form a corner of the storage container 10. The keyways 62 have a slightly larger T-shaped cross-section than the key members 38 and 39 to facilitate easy sliding of the corner members 20 into place engaging two adjacent key members. In such fashion, any corner member 20 can be used to releasably interlock any two adjacent side panels 12, 14, 16, and 18.

The corner members 20 each have an inner portion 61 with a curved inner surface 60 that faces toward the interior area 24 of the storage container 10. The inner portion 61 has a pair of rigid inner flanges **61*a* that form a portion of the curved inner surface 60 and that frictionally engage the web 48 of each of the key members 38 and 39. The inner portion 61 also has a pair of rigid outer flanges 61*b* that frictionally engage the angled inner surfaces 52 of the adjacent first and second edge portions 34 and 36. A narrow throat portion 63 of the corner member 20 extends outward from the inner portion 61 and frictionally engages the inner edge surfaces 57 of the heads 56 of the key members 38 and 39 of the adjacent side panels 12, 14, 16, and 18. The throat portion 63 connects to an outer portion 65 of the corner member 20 that frictionally engages the webs 48 and the outer edge surfaces 59 of the heads 56 of the key members 38 and 39. The outer portion 65 also frictionally engages the outer surfaces 50 of the first and second edge portions 34 and 36 of the adjacent side panels. Accordingly, the corner member 20 frictionally engages almost the entire surface of the key members 38 and 39 of the adjacent side panels 12, 14, 16, and 18** to securely retain the corner member in place and to prevent inadvertent sliding of the corner member relative to the side panels.

Figure 4:
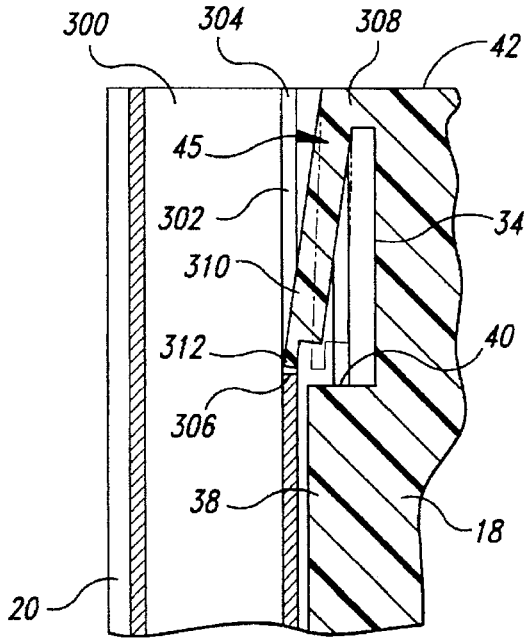
FIG. 4 is an enlarged, fragmentary cross-sectional view taken substantially along line 4—4 of FIG. 1 illustrating a locking tab on a side panel positioned in a tab receiving area in the corner member.

As best seen in FIG. 4, the top portion 300 of each corner member 20 has a tab receiving area 302 in the outer portion 65. The tab receiving area 302 is defined by a cutout in the outer portion 65 of the corner member 20, and the tab receiving area 302 is shaped and sized to receive therein a portion of the locking tab 45 when the corner member is in an installed position on the first edge portion 34 of the side panel. The tab receiving area 302 has an open upper end 304 that is sized to slidably receive the locking tab 45 as the corner member 20 is moved to the installed position such that the tab receiving area is adjacent to the top edge portion 42 of the side panel. The tab receiving area 302 has a closed blocking end 306 opposite the open upper end 304. The closed blocking 306 end is positioned adjacent to the upper portion 40 of the key member 38 and below the locking tab 45 when the corner member 300 is in the installed position.

The locking tab 45 is an inverted, generally L-shaped member having a first leg 308 integrally connected to the first edge portion 34 adjacent to the top edge portion 42 of the side panel 12, 14, and 18. The first leg 308 projects perpendicularly from the first edge portion and is integrally connected to a second leg 310 of the locking tab 45 that is spaced apart from the first edge portion and that extends toward the upper end 40 of the key member 38. The second leg 310 terminates at a free end 312 immediately above the key member 38 and the closed blocking end 306 of the tab receiving area 302 when the corner member 20 is in the installed position, as shown in solid lines in FIG. 4. The free end 312 of the second leg 310 is spaced apart from the first edge portion 34 a distance greater than the depth of the key member 38 from the first edge portion, such that a portion of the second leg is positioned in the tab receiving area 302 with the free end immediately above the closed blocking end 306 of the tab receiving area. Accordingly, the free end 312 of the locking tab's second leg 310 blocks the corner member 20 from inadvertently sliding upward and off of the key member 38.

The locking tab 45 is a resilient member such that the second leg 310 is deflectable from an outward, locking position, shown in solid lines, to an inward, deflected position, shown in phantom lines in FIG. 4, with the free end 312 being closer to the wall surface than when the free end 312 is in the outward, locking position. The second leg 310 deflects to the inward deflected position when the corner member 20 is being installed or removed from the key member 38 to allow the corner member 20 to slide along the key member 38. The second leg 310 is biased toward the outward locking position, such that the second leg springs from the inward deflected position to the outward locking position.

To interlock any two adjacent side panels 12, 14, 16, and 18, the side panels are positioned perpendicular to each other at one edge, and the corner member 20 is positioned above the key members 38 and 39 of the adjacent side panels, such that the key members are aligned with the corresponding corner member key ways 62. The corner member 20 is slid downwardly over the locking tab 45, such that the second leg 310 of the locking tab is moved to the inward, deflected position, shown in phantom lines in FIG. 4, and over the key members 38 and 39 until the second leg snaps to the outward, locking position, shown in FIG. 4 in solid lines, and the bottom of the corner member contacts the shoulders 47 and 471 of the bottom foot portion 46. Accordingly, the corner members 20 can be quickly and easily installed on the side panels and the locking tab 45 leg locks the corner member in place on the side panel.

Similarly, the corner members 20 are easily and quickly removed from the side panels, for example, when the storage container is not in use, by depressing the second leg 310 of the locking tab 45 to the inward, deflected position and sliding the corner member upwardly along the key members until the corner member slides out of engagement with the key members. Thereafter, the side panels 12, 14, 16, and 18 are separated from each other and from the base panel 22, and stacked as a unit with the base panel, secured in place by a retaining strap (not shown) or the like. The corner members 20 can be secured to the side panels 12, 14, 16, and 18 and the base panel 22 for storage, or stored separately, for example, in a large holding container, because the corner members are all interchangeable.

In the preferred embodiment, the corner member 20 has two tab receiving areas 302, one in each of the outer portion 65 of each keyway 62 at opposite ends of the corner member. Accordingly, each corner member 20 can be attached to any two adjacent panels 12, 14, 16, and 18, and either end of the corner member can be positioned to be adjacent to the top edge portion 42 of the side panels such that the locking tab 45 on the first edge portion will extend into the tab receiving area in the top portion 300 of the corner member.

In the illustrated embodiment of FIG. 3, the corner member 20 is an elongated, one-piece member. The outer portion 65 of the corner member 20 has a curved outer surface 58 that extends between the outer surfaces 28 of the adjacent side panels. The curved outer surface 58 provides a smooth and rounded (convex) outer transition between the two adjacent side panels. The curved inner surface 60 of the inner portion 61 extends between the smooth inner surfaces 26 of the adjacent side panels to provide a smooth and rounded (concave) transition between the two adjacent side panels. The curved inner surface 60 is radiused to provide four smooth corner portions for the container's interior area 24 so as to minimize point loads on and hence damage to the products being stored in the storage container 10.

The corner member 20 also has a vertically oriented hollow channel 66 extending through the outer portion 65 and positioned inwardly of the curved outer surface 58. The channel 66 minimizes the weight of the corner members 20 while maintaining sufficient strength, thereby helping to maintain a relatively lightweight storage container. The corner members 20 are constructed of cast aluminum or other suitable metal. However, the corner members 20 can be constructed of extruded plastic or other suitably rigid material that will sufficiently interlock the adjacent side panels 12, 14, 16, and 18.

The key member 38 on the first edge portion 34 of each side panel 12, 14, 16, and 18 is shorter than the key member 39 on the second edge portion 36 by a distance slightly greater than the length of the locking tab 45. The locking tab 45 has a width that is less than the smallest width of the keyway 62 in the corner member 20 so the locking tab can be moved laterally into the keyway without having to slide the keyway over the locking tab. When the storage container 10 is being assembled and two of the side panels 12, 14, 16, and 18 are positioned adjacent to each other, the upper end 401 of the key member 39 of one of the side panels is above the upper end 40 of the key member 38 of the second side panel. The height difference between the key members 38 and 39 on the adjacent side panels facilitates installation of the corner member 20 by allowing the corner member 20 to be slid partially downward over the upper end 401 of the one side panel's key member 39 before reaching the upper end 40 of the second side panel's key member 38. Accordingly, the corner members 20 can be installed quickly and easily to interlock the side panels 12, 14, 16, and 18, and the adjacent side panels do not have to be perfectly aligned or precisely spaced apart to begin installation of the corner member onto the key members of adjacent side panels.

Figure 5:
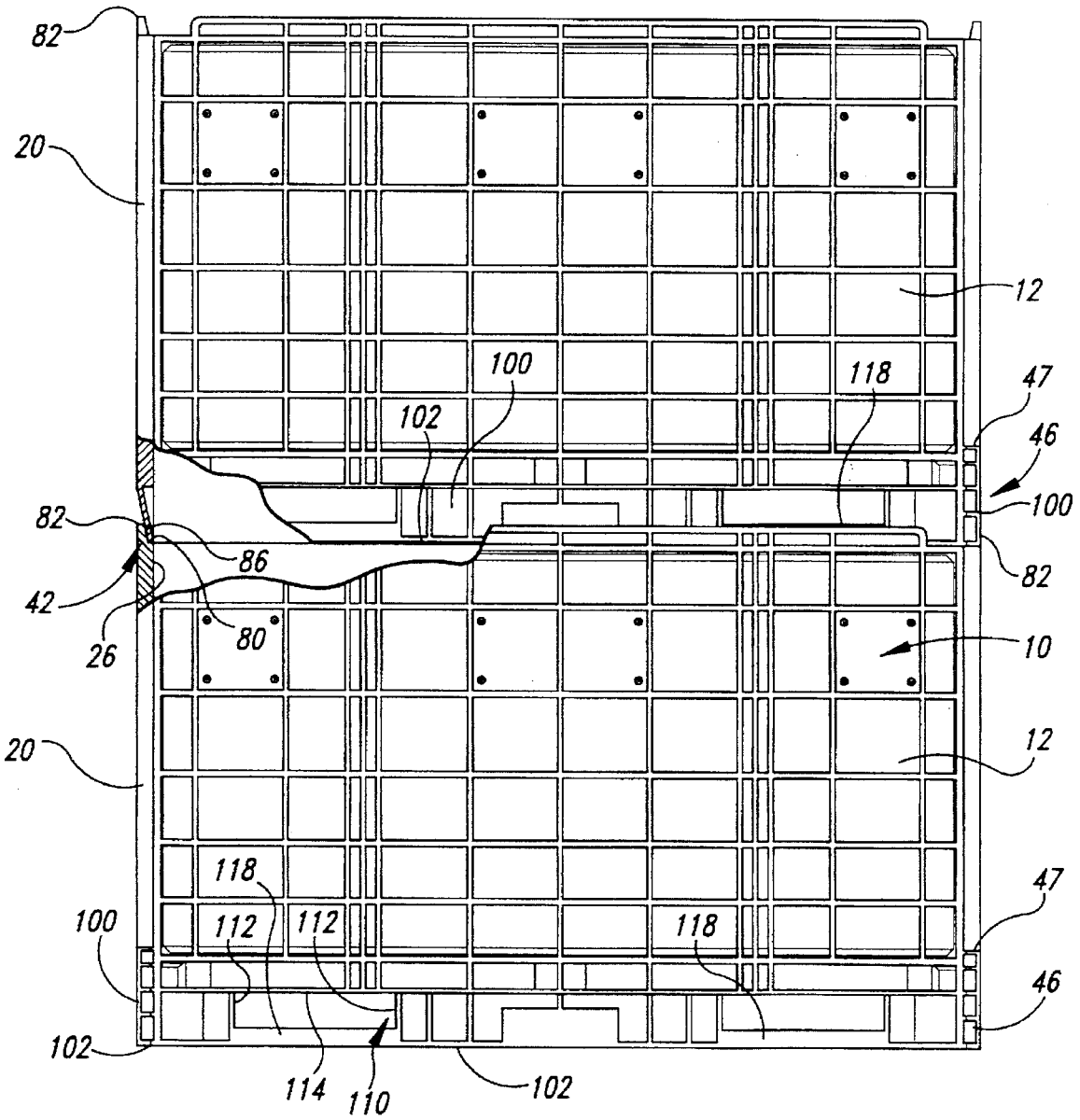
FIG. 5 is a partially cut away, reduced scale front elevational view of two storage containers of FIG. 1 in stacked arrangement.

When the storage container 10 is assembled, as is best seen in FIG. 1, each of the corner members 20 extends upwardly from the shoulders 47 and 471 of the bottom foot portion 46 and terminates at a position level with or slightly below the top edge portions 42 of the side panels 12, 14, 16, and 18. When a plurality of storage containers 10 are stacked one atop another, as best seen in FIG. 5 for two storage containers, the corner members 20 do not bear any of the vertical load exerted by the upper storage container on the lower storage container. The vertical load, from the weight of the upper storage container is supported by the side panels 12, 14, 16, and 18 of the lower storage container. Nonetheless, the corner members 20 are of a sufficient strength to resist horizontal loads exerted on the corner members when the interior area 24 of the storage container is filled with the goods.

As best seen in FIGS. 1 and 5, the top edge portion 42 of each side panel 12, 14, 16, and 18 includes a generally horizontal, flat stacking support 80 adjacent to the respective side panel's inner surface 26 for supporting an upper storage container as shown in FIG. 5 atop the side panels of the lower storage container. An aligning rail 82 extends upwardly away from the stacking support 80 along an outer portion of each top edge portion 42. The aligning rails 82 include an angled, inner wall portion 86 that slopes upwardly and outwardly to provide an aligning and engaging surface around the top of the storage container 10 that acts to align a storage container stacked on its stacking supports 80 of the side panels 12, 14, 16, and 18 as shown in FIG. 5. The aligning rail 82 will correct a small mount of initial misalignment of the upper storage container when being stacked vertically on the lower storage container. Accordingly, the aligning rails 82 allow the upper storage container to be quickly stacked and automatically aligned on the lower storage container to ensure that the upper and lower containers are substantially vertically aligned with the weight of the upper storage container being substantially evenly distributed on the four side panels 12, 14, 16, and 18 of the lower storage container.

When the storage container 10 is assembled, the base panel 22 spans between the side panels 12, 14, 16, and 18 and is supported above the bottom foot portions 46 of the side panels. As best seen in FIG. 2, two opposing side panels each include six horizontally aligned slots 88 above the bottom foot portions 46 that removably receive alignment tabs 90 extending outwardly from two opposing sides of the base panel 22. The other two opposing side panels each have a pair of elongated slots 89 above the bottom foot portions that removably receive a pair of alignment tabs 91 extending outwardly from the other two opposing sides of the base panel 22. In the illustrated embodiment, the storage container 10 has a rectangular shape, and the arrangement of the alignment tabs 90 on opposing sides of the base panel 22 are substantially identical, but different from the arrangement of aligning tabs 91 on the other pair of opposing sides, such that the opposing side panels can be interchanged with each other during assembly of the storage container 10. This interchangeability of the side panels allows for fast assembly of the storage container 10, and provides for fewer different parts to manufacture and to store.

In an alternate embodiment (not shown) the storage container 10 is substantially square, and the arrangement of the alignment tabs 90 is the same on each side of the base panel 22. The locations of the slots 88 on each side panel 12, 14, 16, and 18 are the same such that all of the side panels are completely interchangeable with each other. As indicated above, the corner members 20 are also interchangeable to interlock any two adjacent side panels 12, 14, 16, and 18, thereby maximizing the interchangeability of the storage container's parts.

As best seen in FIGS. 1 and 5, the bottom foot portion 46 of each side panel 12, 14, 16, and 18 extends downwardly away from the base panel 22 and terminates at a bottom edge 102. The bottom foot portion 46 has an angled outer surface 100 that slopes downwardly and inwardly such that the bottom edge 102 is inward of the aligning rail 82 on the respective side panel's top edge portion 42, and the bottom edge 102 is directly below the top edge portion's stacking support 80. The angled outer surface 100 is angled such that when the upper storage container is stacked atop the lower storage container as shown in FIG. 5, the bottom edges 102 of the upper storage container set onto the stacking supports 80 of the lower storage container. The aligning rails 82 of the lower storage container overlap a portion of the angled outer surfaces 100 of the upper storage container to align and retain the upper storage container on the side panels 12, 14, 16, and 18 of the lower container.

As best seen in FIG. 2, each end of the bottom foot portion 46 of each side panel 12, 14, 16, and 18 has a vertical engagement surface 106 that is angled at approximately a 45° angle relative to the outer surface 28 of the side panel. Accordingly, the vertical engagement surfaces 106 of the adjacent side panels 12, 14, 16, and 18 engage each other when the storage container is assembled to define a 90° corner between the bottom foot portions 46 of adjacent side panels.

As best seen in FIGS. 2 and 5, each of the bottom foot portions 46 has two guideways 110 extending fully therethrough that are aligned with a corresponding guideway on the opposing side panel, and that are shaped and sized to receive the fork of a forked moving device (not shown) such as a forklift, pallet lift, or the like. Each of the guideways 110 is defined by opposing vertical sidewalls 112 that extend upwardly from the bottom edge 102 of the bottom foot portion 46 and terminate at a horizontal top wall 114 spanning between the vertical sidewalls 112. The horizontal top wall 114 is located below the slots 88 in the side panel. The guideways 110 each have an open side opposite the horizontal top wall 114, and the open side is defined by a space in the bottom edge 102 of the respective bottom foot portion 46. Accordingly, when the forked moving device is used to lift a storage container 10, the fork extends through opposing guideways 110, and engages the top wall 114 of the guideways 110, thereby lifting the storage container 10.

In one embodiment shown on two side panels 14 and 18 in FIG. 2, the guideways are open along the bottom such that the fork of a forklift can move into or out of the guideway through the bottom. In another embodiment, shown on two side panels 12 and 16 in FIG. 2, each of the vertical sidewalls 112 of the guideways 110 is integrally connected to a footrail portion 118 that span across the bottom of the guideway. Each footrail portion 118 provides a closure member along the bottom of the respective guideway 110 so as to define a four-sided aperture that is shaped and sized to receive the fork of the forked moving device. When the footrail portions 118 are installed and the fork is positioned in the opposing guideways 110 above the footrail portions and below the top walls 114, the forked moving device can not only lift the storage container 10, but can also turn it upside-down, for example, during a dumping process. The bottom footrail portions 118 retain the storage container 10 on the fork in an inverted position.

In an alternate embodiment of the present invention in FIG. 2, only two opposing side panels 12 and 16, or 14 and 18, have the guideways 110 formed therein, and the bottom foot portions 46 of the other two side panels do not have guideways. In another alternate embodiment of the invention, the bottom foot portions 46 of opposing side panels, 12 and 16, or 14 and 18, have a single guideway 110 therein that is shaped and sized to receive a single fork of a forked moving device. In this second alternate embodiment, a single footrail portion 118 extends across the single guideway 110.

Although particular embodiments of the storage container with interlocking corner members have been described in this application for illustrative purposes, the claims are not limited to the embodiments described herein. Equivalent components may be substituted for those described which operate according to the principles of the present invention and thus fall within the scope of the claims.

We claim:

1. A collapsible storage container, comprising:

a base having four perimeter portions;

four side panels removably connected to said base, each at one of said perimeter portions, each of said side panels having first and second edge portions, said first and second edge portions being substantially perpendicular to said base and spaced apart from each other when said side panels are connected to said base, each of said first and second edge portions having a key member, said first edge portion of each side panel being adjacent to said second edge portion of another said side panel when connected to said base; and four elongated corner members removably interlocking said side panels, each of said corner members having substantially identical construction to removably interlock said first edge portion of one side panel and said second edge portion of another side panel, such that each corner member can be used to interlock any two of said side panels with said first edge portion of one side panel adjacent to said second edge portion of another side panel, each of said corner members having a pair of keyways therein, each sized to slidably receive and retain said key members of said first edge portion of one side panel adjacent to said second edge portion of another side panel, and said key member of said first edge portion having a first height relative to said base when said side panels are connected to said base, and said key member of said second edge portion having a second height relative to said base when said side panels are connected to said base, said first height being greater than said second height, such that one of said corner members will engage said key member of said first edge portion of one side panel before engaging said key member of said second edge portion of another side panel during installation of said corner member onto said one side panel and said another side panel.

2. The collapsible storage container of claim 1 wherein when said side panels are connected to said base define an interior area of said storage container with four corners, and each of said corner members has a radiused inner surface extending longitudinally along said corner member, and located between said keyways to provide a curved transition surface between adjacent ones of said side panels when said side panels are connected to said base at said corners.

3. The collapsible storage container of claim 1 wherein each of said corner members is symmetrical about a longitudinally extending plane of symmetry.

4. The collapsible storage container of claim 3 wherein each of said key members has a generally T-shaped cross-section, and each of said keyways has a generally corresponding T-shaped cross-section sized larger than said key member to slidably receive said key members.

5. A collapsible storage container, comprising:

a base having four perimeter portions;

four side panels removably connected to said base, each at one of said perimeter portions, each of said side panels having first and second edge portions, said first and second edge portions being substantially perpendicular to said base and spaced apart from each other when said side panels are connected to said base, each of said first and second edge portions having a key member, said first edge portion of each side panel being adjacent to said second edge portion of another said side panel when connected to said base; and four elongated corner members removably interlocking said side panels, each of said corner members having substantially identical construction to removably interlock said first edge portion of one side panel and said second edge portion of another side panel, such that each corner member can be used to interlock any two of said side panels with said first edge portion of one side panel adjacent to said second edge portion of another side panel, each of said corner members having a pair of keyways therein, each sized to slidably receive and retain said key members of said first edge portion of one side panel adjacent to said second edge portion of another side panel, said first edge portion having a locking tab attached thereto adjacent to said key member of said first edge portion, said locking tab being shaped to releasably retain one of said corner members on said key member of said first edge portion.

6. The collapsible storage container of claim 5 wherein said one of said corner members has a tab receiving area that removably receives a portion of said locking tab therein, said tab receiving area having a closed end positionable adjacent to said locking tab to releasably engage said locking tab to retain said one of said corner members on said key member of said first edge portion.

7. The collapsible storage container of claim 1 wherein each of said side panels has a top edge portion extending between said first and second edge portions, and a bottom foot portion opposite said top edge portion, said top edge portion has a stacking support and a stacking alignment rail extending away from said stacking support, and said bottom foot portion terminates at a bottom edge located directly below said top edge portion.

8. The collapsible storage container of claim 7 wherein said stacking alignment rail is located along an outward portion of said stacking support, and said bottom foot portion extends downward from said base and slopes inward of said stacking alignment rail and terminates in a position inward of said stacking alignment rail.

9. The collapsible storage container of claim 8 wherein said stacking alignment rail has first and second ends spaced apart from each other, said stacking alignment rail extends along the length of said top edge portion, said first end of said stacking alignment rail being located toward said first edge portion and said second end of said stacking alignment rail being located toward said second edge portion.

10. The collapsible storage container of claim 1 for use with a forked moving device, wherein each of said side panels is positioned opposite another one of said side panels when connected to said base, and each of said side panels has a bottom foot portion located below said base when connected to said base, said bottom foot portions of at least two opposing ones of said side panels having a guideway therethrough shaped to removably receive forks of the forked moving device.

11. The collapsible storage container of claim 10, further including a footrail portion attached to said bottom foot portion of one of said opposing ones of said side panels to span across said guideway to define a fork receiving aperture closed on four sides.

12. The collapsible storage container of claim 1 for use with a forked moving device, wherein each of said side panels is positioned opposite another one of said side panels when connected to said base, and each of said side panels has a bottom foot portion located below said base when connected to said base, said bottom foot portions of at least two opposing ones of said side panels having a pair of guideways therethrough shaped to removably receive forks of the forked moving device, and said storage container further includes a plurality of footrail portions, each of said plurality of footrail portions being attached to said bottom foot portion of one of said opposing ones of said side panels to span across one of said pair of guideways to define a fork receiving aperture dosed on all four sides.

13. The collapsible storage container of claim 1 wherein each of said corner members has a first and second end spaced apart from each other and a pair of elongated keyways each extending along the length of said corner member, each of said keyways being shaped to slidably receive and retain one of said key members.

14. The collapsible storage container of claim 1 wherein each of said side panels has a top edge portion extending between said first and second edge portions, and a bottom foot portion opposite said top edge portion, and each of said key members has first and second ends spaced apart from each other, each of said key members extending between said top edge portion and said bottom foot portion, said first end of said key member being located toward said top edge portion and said second end of said key member being adjacent to said bottom foot portion.

15. The collapsible storage container of claim 1 wherein each of said side panels has a top edge portion extending between said first and second edge portions, and a bottom foot portion opposite said top edge portion, and each of said first and second edge portions have first and second ends spaced apart from each other, each of said first ends being adjacent to said top edge portion and each of said second ends being adjacent to said bottom foot portion.

* * * * *